US007481431B2

(12) United States Patent
Miller et al.

(10) Patent No.: US 7,481,431 B2
(45) Date of Patent: Jan. 27, 2009

(54) BINGO-STYLE LOTTERY GAME TICKET

(75) Inventors: Dennis Miller, Cumming, GA (US); Jeffrey Martineck, Sr., Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 352 days.

(21) Appl. No.: 11/343,300

(22) Filed: Jan. 31, 2006

(65) Prior Publication Data

US 2006/0170153 A1 Aug. 3, 2006

Related U.S. Application Data

(60) Provisional application No. 60/648,802, filed on Feb. 1, 2005.

(51) Int. Cl.
*A63F 3/06* (2006.01)

(52) U.S. Cl. ..... 273/139; 273/269; 283/901; 283/903

(58) Field of Classification Search ..... 273/139, 273/269; 283/901, 903
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | Nugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |

(Continued)

FOREIGN PATENT DOCUMENTS

| | | |
|---|---|---|
| AU | B-18428/92 | 12/1992 |

(Continued)

OTHER PUBLICATIONS

'Are You In?', (Article).

(Continued)

*Primary Examiner*—Benjamin H Layno
(74) *Attorney, Agent, or Firm*—Dority & Manning, P.A.

(57) ABSTRACT

A scratch-off lottery game card that simulates the rules of the game of Bingo. On the card, there is a first set of game indicia of a first type arranged in a grid that has at least one row of cells having a indicia of a second type with a unique one of the indicia of the second type defining a particular column of the grid. There is a second set of game indicia on the card, each a grouping of one of the first and second type of game indicia such that each defines a potential one of the first type of indicia in a column of cells of the grid of first set of game indicia. A set of prize indicators is adjacent the grid of the first set of game indicia thereby defining a row of the grid and indicating the prize for matching a defined row.

19 Claims, 2 Drawing Sheets

U.S. PATENT DOCUMENTS

| | | | | |
|---|---|---|---|---|
| 3,934,120 | A | | 1/1976 | Maymarev |
| 4,017,834 | A | | 4/1977 | Cuttill et al. |
| 4,095,824 | A | | 6/1978 | Bachman |
| 4,105,156 | A | | 8/1978 | Dethloff |
| 4,176,406 | A | | 11/1979 | Matkan |
| 4,191,376 | A | | 3/1980 | Goldman et al. |
| 4,194,296 | A | | 3/1980 | Pagnozzi et al. |
| 4,195,772 | A | | 4/1980 | Nishimura |
| 4,206,920 | A | | 6/1980 | Weatherford et al. |
| 4,241,942 | A | | 12/1980 | Bachman |
| 4,243,216 | A | | 1/1981 | Mazumder |
| 4,273,362 | A | | 6/1981 | Carrier et al. |
| 4,309,452 | A | | 1/1982 | Sachs |
| 4,313,087 | A | | 1/1982 | Weitzen et al. |
| 4,355,300 | A | | 10/1982 | Weber |
| 4,375,666 | A | | 3/1983 | Buck et al. |
| 4,398,708 | A | | 8/1983 | Goldman et al. |
| 4,407,443 | A | | 10/1983 | McCorkle |
| 4,451,759 | A | | 5/1984 | Heynisch |
| 4,455,039 | A | | 6/1984 | Weitzen et al. |
| 4,457,430 | A | | 7/1984 | Darling et al. |
| 4,464,423 | A | | 8/1984 | LaBianca et al. |
| 4,466,614 | A | | 8/1984 | Bachman et al. |
| 4,488,646 | A | | 12/1984 | McCorkle |
| 4,491,319 | A | | 1/1985 | Nelson |
| 4,494,197 | A | | 1/1985 | Troy et al. |
| 4,536,218 | A | | 8/1985 | Ganho |
| 4,544,184 | A | | 10/1985 | Freund et al. |
| 4,579,371 | A | | 4/1986 | Long et al. |
| 4,591,189 | A | | 5/1986 | Holmen et al. |
| 4,634,149 | A | | 1/1987 | Donovan |
| 4,665,502 | A | | 5/1987 | Kreisner |
| 4,669,729 | A | | 6/1987 | Solitt et al. |
| 4,689,742 | A | | 8/1987 | Troy et al. |
| 4,726,608 | A | | 2/1988 | Walton |
| 4,736,109 | A | | 4/1988 | Dvorzsak |
| 4,740,016 | A | | 4/1988 | Konecny et al. |
| 4,760,247 | A | | 7/1988 | Keane et al. |
| 4,763,927 | A | | 8/1988 | Schneider |
| 4,775,155 | A | | 10/1988 | Lees |
| 4,792,667 | A | | 12/1988 | Chen |
| 4,805,907 | A | | 2/1989 | Hagiwara |
| 4,817,951 | A | | 4/1989 | Crouch et al. |
| 4,835,624 | A | | 5/1989 | Black et al. |
| 4,836,546 | A | | 6/1989 | Dire et al. |
| 4,836,553 | A | | 6/1989 | Suttle et al. |
| 4,837,728 | A | | 6/1989 | Barrie et al. |
| 4,856,787 | A | | 8/1989 | Itkis |
| 4,861,041 | A | | 8/1989 | Jones et al. |
| 4,870,260 | A | | 9/1989 | Niepolomski et al. |
| 4,880,964 | A | | 11/1989 | Donahue |
| 4,888,964 | A | | 12/1989 | Klinge |
| 4,922,522 | A | | 5/1990 | Scanlon |
| 4,943,090 | A | | 7/1990 | Fienberg |
| 4,960,611 | A | | 10/1990 | Fujisawa et al. |
| 4,961,578 | A | | 10/1990 | Chateau |
| 4,964,642 | A | | 10/1990 | Kamille |
| 4,996,705 | A | | 2/1991 | Entenmann et al. |
| 4,998,010 | A | | 3/1991 | Chandler et al. |
| 4,998,199 | A | | 3/1991 | Tashiro et al. |
| 5,032,708 | A | | 7/1991 | Comerford et al. |
| 5,037,099 | A | | 8/1991 | Burtch |
| 5,046,737 | A | | 9/1991 | Fienberg |
| 5,074,566 | A | | 12/1991 | Desbiens |
| 5,083,815 | A | | 1/1992 | Scrymgeour et al. |
| 5,092,598 | A | | 3/1992 | Kamille |
| 5,094,458 | A | | 3/1992 | Kamille |
| 5,100,139 | A | | 3/1992 | Di Bella |
| 5,109,153 | A | | 4/1992 | Johnson et al. |
| 5,112,050 | A | | 5/1992 | Koza et al. |
| 5,116,049 | A | | 5/1992 | Sludikoff et al. |
| 5,118,109 | A | | 6/1992 | Gumina |
| 5,119,295 | A | | 6/1992 | Kapur |
| 5,158,293 | A | | 10/1992 | Mullins |
| 5,165,967 | A | | 11/1992 | Theno et al. |
| 5,186,463 | A | | 2/1993 | Marin et al. |
| 5,189,292 | A | | 2/1993 | Batterman et al. |
| 5,193,815 | A | | 3/1993 | Pollard |
| 5,193,854 | A | | 3/1993 | Borowski, Jr. et al. |
| 5,228,692 | A | | 7/1993 | Carrick et al. |
| 5,232,221 | A | | 8/1993 | Sludikoff et al. |
| 5,234,798 | A | | 8/1993 | Heninger et al. |
| 5,249,801 | A | | 10/1993 | Jarvis |
| 5,259,616 | A | | 11/1993 | Bergmann |
| 5,273,281 | A | | 12/1993 | Lovell |
| 5,276,980 | A | | 1/1994 | Carter et al. |
| 5,282,620 | A | | 2/1994 | Keesee |
| 5,308,992 | A | | 5/1994 | Crane et al. |
| 5,317,135 | A | | 5/1994 | Finocchio |
| 5,326,104 | A | | 7/1994 | Pease et al. |
| 5,332,219 | A | | 7/1994 | Marnell, II et al. |
| 5,342,047 | A | | 8/1994 | Hiedel et al. |
| 5,342,049 | A | | 8/1994 | Wichinsky et al. |
| 5,344,144 | A | | 9/1994 | Canon |
| 5,346,258 | A | | 9/1994 | Behn et al. |
| 5,380,007 | A | | 1/1995 | Travis et al. |
| 5,393,057 | A | | 2/1995 | Marnell, II et al. |
| 5,401,024 | A | | 3/1995 | Simunek |
| 5,403,039 | A | | 4/1995 | Borowski, Jr. et al. |
| 5,407,199 | A | | 4/1995 | Gumina |
| 5,420,406 | A | | 5/1995 | Izawa et al. |
| 5,432,005 | A | | 7/1995 | Tanigami et al. |
| 5,451,052 | A | | 9/1995 | Behm et al. |
| 5,456,465 | A | | 10/1995 | Durham |
| 5,456,602 | A | | 10/1995 | Sakuma |
| 5,471,040 | A | | 11/1995 | May |
| 5,475,205 | A | | 12/1995 | Behm et al. |
| 5,486,005 | A | | 1/1996 | Neal |
| 5,513,846 | A | | 5/1996 | Niederlien et al. |
| 5,528,154 | A | | 6/1996 | Leichner et al. |
| 5,536,016 | A | | 7/1996 | Thompson |
| 5,540,442 | A | | 7/1996 | Orselli et al. |
| 5,544,881 | A | * | 8/1996 | Rua et al. ..... 273/139 |
| 5,548,110 | A | | 8/1996 | Storch et al. |
| 5,550,746 | A | | 8/1996 | Jacobs |
| 5,560,610 | A | * | 10/1996 | Behm et al. ..... 273/269 |
| 5,564,700 | A | | 10/1996 | Celona |
| 5,564,977 | A | | 10/1996 | Algie |
| 5,591,956 | A | | 1/1997 | Longacre, Jr. et al. |
| 5,599,046 | A | | 2/1997 | Behm et al. |
| 5,602,381 | A | | 2/1997 | Hoshino et al. |
| 5,621,200 | A | | 4/1997 | Irwin et al. |
| 5,628,684 | A | | 5/1997 | Bouedec |
| 5,630,753 | A | | 5/1997 | Fuchs |
| 5,651,735 | A | | 7/1997 | Baba |
| 5,655,961 | A | | 8/1997 | Acres et al. |
| 5,657,991 | A | * | 8/1997 | Camarato ..... 273/269 |
| 5,667,250 | A | | 9/1997 | Behm et al. |
| 5,682,819 | A | | 11/1997 | Beatty |
| 5,690,366 | A | | 11/1997 | Luciano |
| 5,704,647 | A | | 1/1998 | Desbiens |
| 5,722,891 | A | | 3/1998 | Inoue |
| 5,726,898 | A | | 3/1998 | Jacobs |
| 5,732,948 | A | | 3/1998 | Yoseloff |
| 5,741,183 | A | | 4/1998 | Acres et al. |
| 5,743,800 | A | | 4/1998 | Huard et al. |
| 5,752,882 | A | | 5/1998 | Acres et al. |
| 5,756,220 | A | | 5/1998 | Hoshino et al. |
| 5,768,142 | A | | 6/1998 | Jacobs |
| 5,769,458 | A | | 6/1998 | Carides et al. |
| 5,770,533 | A | | 6/1998 | Franchi |
| 5,772,509 | A | | 6/1998 | Weiss |
| 5,772,510 | A | | 6/1998 | Roberts |
| 5,772,511 | A | | 6/1998 | Smeltzer |

| | | | |
|---|---|---|---|
| RE35,864 | E | 7/1998 | Weingardt |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |
| 5,803,504 | A | 9/1998 | Deshiens et al. |
| 5,816,920 | A | 10/1998 | Hanai |
| 5,818,019 | A | 10/1998 | Irwin, Jr. et al. |
| 5,820,459 | A | 10/1998 | Acres et al. |
| 5,823,874 | A | 10/1998 | Adams |
| 5,830,063 | A | 11/1998 | Byrne |
| 5,830,066 | A | 11/1998 | Goden et al. |
| 5,830,067 | A | 11/1998 | Graves et al. |
| 5,833,537 | A | 11/1998 | Barrie |
| 5,835,576 | A | 11/1998 | Katz et al. |
| 5,836,086 | A | 11/1998 | Elder |
| 5,836,817 | A | 11/1998 | Acres et al. |
| 5,848,932 | A | 12/1998 | Adams |
| 5,863,075 | A | 1/1999 | Rich et al. |
| 5,871,398 | A | 2/1999 | Schneier et al. |
| 5,876,284 | A | 3/1999 | Acres et al. |
| 5,882,261 | A | 3/1999 | Adams |
| 5,883,537 | A | 3/1999 | Luoni et al. |
| 5,885,158 | A | 3/1999 | Torango et al. |
| 5,887,906 | A | 3/1999 | Sultan |
| 5,903,340 | A | 5/1999 | Lawady et al. |
| 5,911,418 | A | 6/1999 | Adams |
| 5,915,588 | A | 6/1999 | Stoken et al. |
| 5,934,671 | A | 8/1999 | Harrison |
| 5,970,143 | A | 10/1999 | Shneier et al. |
| 5,979,894 | A | 11/1999 | Alexoff |
| 5,996,997 | A | 12/1999 | Kamille |
| 5,997,044 | A | 12/1999 | Behm et al. |
| 6,003,307 | A | 12/1999 | Naber et al. |
| 6,004,207 | A | 12/1999 | Wilson, Jr. et al. |
| 6,007,162 | A | 12/1999 | Hinz et al. |
| 6,012,982 | A | 1/2000 | Piechowiak et al. |
| 6,014,032 | A | 1/2000 | Maddix et al. |
| 6,017,032 | A | 1/2000 | Grippo et al. |
| 6,024,641 | A | 2/2000 | Sarno |
| 6,053,405 | A | 4/2000 | Irwin, Jr. et al. |
| 6,077,162 | A | 6/2000 | Weiss |
| 6,080,062 | A | 6/2000 | Olson |
| 6,086,477 | A | 7/2000 | Walker et al. |
| 6,089,978 | A | 7/2000 | Adams |
| 6,099,407 | A | 8/2000 | Parker, Jr. et al. |
| 6,102,400 | A | 8/2000 | Scott et al. |
| 6,107,913 | A | 8/2000 | Gatto et al. |
| 6,119,364 | A | 9/2000 | Elder |
| 6,125,368 | A | 9/2000 | Bridge et al. |
| 6,142,872 | A | 11/2000 | Walker et al. |
| 6,146,272 | A | 11/2000 | Walker et al. |
| 6,149,521 | A | 11/2000 | Sanduski |
| 6,155,491 | A | 12/2000 | Dueker et al. |
| 6,168,521 | B1 | 1/2001 | Luciano et al. |
| 6,168,522 | B1 | 1/2001 | Walker et al. |
| 6,179,710 | B1 | 1/2001 | Sawyer et al. |
| 6,203,430 | B1 | 3/2001 | Walker et al. |
| 6,206,373 | B1 | 3/2001 | Garrod |
| 6,210,275 | B1 | 4/2001 | Olsen |
| 6,217,448 | B1 | 4/2001 | Olsen |
| 6,220,961 | B1 | 4/2001 | Keane et al. |
| 6,224,055 | B1 | 5/2001 | Walker et al. |
| 6,227,969 | B1 | 5/2001 | Yoseloff |
| 6,238,288 | B1 | 5/2001 | Walker et al. |
| 6,296,250 | B1 * | 10/2001 | Langan ..... 273/139 |
| 6,309,300 | B1 | 10/2001 | Glavich |
| 6,312,334 | B1 | 11/2001 | Yoseloff |
| 6,315,291 | B1 | 11/2001 | Moody |
| 6,330,976 | B1 | 12/2001 | Dymetman et al. |
| 6,331,143 | B1 | 12/2001 | Yoseloff |
| 6,334,814 | B1 | 1/2002 | Adams |
| 6,340,158 | B2 | 1/2002 | Pierce et al. |
| 6,368,213 | B1 | 4/2002 | McNabola |
| 6,375,568 | B1 | 4/2002 | Roffman et al. |
| 6,379,742 | B1 | 4/2002 | Behm et al. |
| 6,394,899 | B1 | 5/2002 | Walker et al. |
| 6,398,214 | B1 | 6/2002 | Moteki et al. |
| 6,398,643 | B1 | 6/2002 | Knowles et al. |
| 6,398,644 | B1 | 6/2002 | Perrie et al. |
| 6,398,645 | B1 | 6/2002 | Yoseloff |
| 6,416,408 | B2 | 7/2002 | Tracy et al. |
| 6,419,579 | B1 | 7/2002 | Bennett |
| 6,435,408 | B1 | 8/2002 | Irwin, Jr. et al. |
| 6,435,500 | B2 | 8/2002 | Gumina |
| 6,478,677 | B1 | 11/2002 | Moody |
| 6,491,215 | B1 | 12/2002 | Irwin, Jr. et al. |
| 6,497,408 | B1 | 12/2002 | Walker et al. |
| 6,552,290 | B1 | 4/2003 | Lawandy |
| 6,588,747 | B1 | 7/2003 | Seelig |
| 6,599,186 | B1 | 7/2003 | Walker et al. |
| 6,601,772 | B1 | 8/2003 | Rubin et al. |
| 6,637,747 | B1 | 10/2003 | Garrod |
| 6,648,735 | B2 | 11/2003 | Miyashita et al. |
| 6,648,753 | B1 | 11/2003 | Tracy et al. |
| 6,648,755 | B1 | 11/2003 | Luciano et al. |
| 6,676,126 | B1 | 1/2004 | Walker et al. |
| 6,692,354 | B2 | 2/2004 | Tracy et al. |
| 6,702,047 | B2 | 3/2004 | Huber |
| 6,773,345 | B2 | 8/2004 | Walker et al. |
| 6,776,337 | B2 | 8/2004 | Irwin, Jr. et al. |
| 6,786,824 | B2 | 9/2004 | Cannon |
| 6,823,874 | B2 | 11/2004 | Lexcen |
| 6,875,105 | B1 | 4/2005 | Behm et al. |
| 6,929,186 | B2 | 8/2005 | Lapstun |
| 2001/0027130 | A1 | 10/2001 | Namba et al. |
| 2001/0030978 | A1 | 10/2001 | Holloway et al. |
| 2001/0034262 | A1 | 10/2001 | Banyai |
| 2001/0040345 | A1 | 11/2001 | Au-Yeung |
| 2002/0022511 | A1 | 2/2002 | Eklund et al. |
| 2002/0084335 | A1 | 7/2002 | Ericson |
| 2002/0171201 | A1 | 11/2002 | Au-Yeung |
| 2002/0187825 | A1 | 12/2002 | Tracy et al. |
| 2003/0050109 | A1 | 3/2003 | Caro et al. |
| 2003/0114210 | A1 | 6/2003 | Meyer et al. |
| 2004/0076310 | A1 | 4/2004 | Hersch et al. |
| 2004/0173965 | A1 | 9/2004 | Stanek |
| 2004/0178582 | A1 | 9/2004 | Garrod |
| 2004/0185931 | A1 | 9/2004 | Hartman et al. |
| 2004/0204222 | A1 | 10/2004 | Roberts |
| 2004/0259631 | A1 | 12/2004 | Katz et al. |
| 2004/0266514 | A1 | 12/2004 | Penrice |

FOREIGN PATENT DOCUMENTS

| | | |
|---|---|---|
| AU | B-21070/92 | 7/1993 |
| AU | A-50327/96 | 2/1997 |
| AU | B-52499/96 | 2/1997 |
| AU | 199716432 B2 | 9/1997 |
| AU | A-45403/97 | 4/1998 |
| AU | A-63553/98 | 10/1998 |
| DE | 2938307 C2 | 4/1981 |
| DE | 3035898 A1 | 4/1982 |
| DE | 3035947 A1 | 5/1982 |
| DE | 2938307 C3 | 6/1982 |
| DE | 29803107 U1 | 8/1988 |
| DE | 3822636 A1 | 1/1990 |
| DE | 2938307 C3 | 8/1990 |
| DE | 3822636 A1 | 1/1992 |
| DE | 3415114 A1 | 10/1995 |
| DE | 19646956 C1 | 5/1998 |
| DE | 19706286 A1 | 5/1998 |
| DE | 29816453 U1 | 4/1999 |
| DE | 19751746 A1 | 5/1999 |
| EP | 0122902 B1 | 4/1984 |
| EP | 0333934 A1 | 9/1989 |

| | | | |
|---|---|---|---|
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 529535 | | 6/1983 |
| ES | 529536 | | 6/1983 |
| ES | 2006400 | | 4/1989 |
| ES | 2006401 | | 4/1989 |
| GB | 642892 | A | 9/1950 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| JP | 02235744 | | 8/2002 |
| JP | 04132672 | | 4/2004 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |

OTHER PUBLICATIONS

'Beginner's Guide—How To Bet', (www.plimico.com/How+to+wager/beginnersguide/), (Internet Article), 3 Pgs.

Chip Brown, 'Austin American-Statesman', (Article), May 28, 1998, 2 Pgs., Texas.

John C. Hallyburton, Jr., 'Frequently Asked Questions About Keno', (Internet Article),1995, 1998, 10 Pgs., (http://conielco.com/faq/keno.html).

'Horse betting Tutorial—Types of Bets' (www.homepokergames.com/horsebettingtutorial.php), (Internet Article), 2 Pgs.

Judith Gaines, 'Pool Party Betting Business Booming Throughout Area Workplaces', (Internet Article), Mar. 19, 1994, 2 Pgs., Issue 07431791, Boston Globe, Boston, MA.

'Maryland Launches Let It Ride', (Internet Article), Circa 2001,1 Pg.

'Notice of Final Rulemaking', (Internet Article) Mar. 24, 2000, 10 Pgs., vol. 6, Issue #13, Arizona Administrative Register, Arizona.

'How To Play Megabucks', (Internet Article), Mar. 9, 2001, 2 Pgs., Oregon Lottery Megabucks,(http://www.oregonlottery.org/mega/m_howto.htm).

'How To Play Megabucks', (Internet Article), May 8, 2001, 2 Pgs., Oregon Lottery Megabucks, (http://www.oregonlottery.org/mega/m_howto.htm).

'Oregon Lottery', (Internet Article), Apr. 30, 2004, 9 Pgs., Oregon Lottery Web Center, (http://www.oregonlottery.org/general/g_hist.shtml).

'Powerball Odd & Prizes', 'How to Play Powerball', (Internet Article), Dec. 2002, 2 Pgs., (www.powerball.com/pbhowtoplay.shtm).

'Powerball Prizes and Odds', (Internet Article), 2 Pgs., http://www.powerball.com/pbprizesNOdds.shtm.

'Learn To Play the Races' (Internet Article), 15 Pgs., Racing Daily Form (www.drf.com).

Mike Parker, 'The History of Horse Racing' (Internet Article),1996,1997,1998, 5 Pgs., http://www.mrmike.com/explore/hrhist.htm.

* cited by examiner

BINGO-STYLE LOTTERY GAME TICKET

CROSS-REFERENCE TO RELATED APPLICATION

This application claims the benefit of U.S. Provisional Patent Application No. 60/648,802, filed Feb. 1, 2005, the entirety of which is incorporated herein by this reference.

BACKGROUND OF THE INVENTION

1. Field of the Invention

The invention relates in general to lottery scratch-off ticket or instant win games. More particularly, the invention relates to a novel bingo-style lottery scratch-off ticket and game.

2. Background of the Invention

Lottery authorities and other gaming entities have used "scratch-off" instant win tickets for some time. These tickets typically have a latex or other removable coating placed over a set of game indicia on the ticket and removal of the latex, i.e. scratching it off, reveals the game indicia and whether or not the ticket is a winner. One problem that occurs is that the player of the instant win scratch off games become bored with the simple scratch and reveal approach to game play. To maintain player interest, there have been several variations of game simulated on instant-win scratch off lottery tickets.

There have been some scratch off tickets that have attempted to simulated the game of "bingo" in which known types of lottery bingo instant game cards or tickets use a prize legend to determine prizes to be won. In the game of Bingo, each player is given a card marked with a grid containing a unique combination of numbers, and sometimes includes blank spaces. The winning pattern to be formed on the card is announced, which typically is a straight line of full spaces across the card. On each turn, a non-player known as the "caller" randomly selects a number, most commonly via drawing a numbered ball from a container, and announces the number to all the players. The ball is then set aside so that it cannot be chosen again. Each player searches their card for the called number, and marks any matches. The caller continues to select and announce numbers until the first player forms the agreed pattern (one line, two lines, full house, etc.) on their card and shouts out the name of the pattern or "bingo."

One version of a previous lottery scratch-off lottery card simulating bingo simply had a scratch and reveal grid, with the prizes are determined by the type of "bingo" completed in the known fashion, for example a line across, 4 Corners, an "X" or other pattern on the game ticket. The determination of the winning ticket therefore required the player to determine if the winning pattern was present, which allowed significant error by the player.

Therefore, it is desirous to create a scratch-off lottery ticket that can simulate the game of bingo, yet be easy for the player to understand whether the ticket is a winner. It is thus to the provision of such a lottery scratch-off game card that the present invention is primarily directed.

SUMMARY OF THE INVENTION

The invention is a scratch-off lottery game card that simulates the rules of the game of Bingo, and its method of creation. In one embodiment, the scratch-off lottery game card includes a substrate, with a first set of game indicia of a first type on the substrate and arranged in a grid comprised of a plurality of rows and columns of cells, the grid having at least one row of cells having a indicia of a second type with a unique one of the indicia of a second type defining a particular row of the grid. There is a second set of game indicia on the substrate, with each of the second set of game indicia comprised of a grouping of one of the first type of game indicia and one of the second type of game indicia such that each of the second set of indicia defines a potential indicia of a first type in a column of cells the grid of first set of game indicia, and there is a set of prize indicators on the substrate adjacent the grid of the first set of game indicia thereby defining a row of the grid, wherein each of the prize indicators indicates a prize for a defined row wherein each cell of the defined row containing a game indicia of the first type.

The invention also includes a method of making a scratch-off lottery game card simulating the game of Bingo with the step of placing a first set of game indicia of a first type on a substrate wherein the first set of game indicia is arranged in a grid comprised of a plurality of rows and columns of cells, placing at least one row of cells of the grid with an indicia of a second type wherein a unique one of the indicia of a second type defining a particular row of the grid, placing a second set of game indicia on the substrate, each of the second set of game indicia comprised of a grouping of one of the first type of game indicia and one of the second type of game indicia such that each of the second set of indicia defines a potential indicia of a first type in a column of cells of the grid of first set of game indicia. Then the method includes the step of placing a set of prize indicators on the substrate adjacent the grid of the first set of game indicia thereby defining a row of the grid, wherein each of the prize indicators indicates a prize for a defined row wherein each cell of the defined row containing a game indicia of the first type.

The novel play style and game ticket of the present bingo game differs from the known types of scratch-off games in that the purchaser will use one player's game card or ticket and the numbers under each letter (column) of the game card and of each horizontal line has a variable prize that may be the same or differ as the next horizontal line. This allows the player to easily determine a winning card.

Other objects, features and advantages of the present invention will become apparent after review of the hereinafter set forth Brief Description of the Drawings, Detailed Description of the Invention, and the Claims.

DETAILED DESCRIPTION OF THE INVENTION

Figure 1:
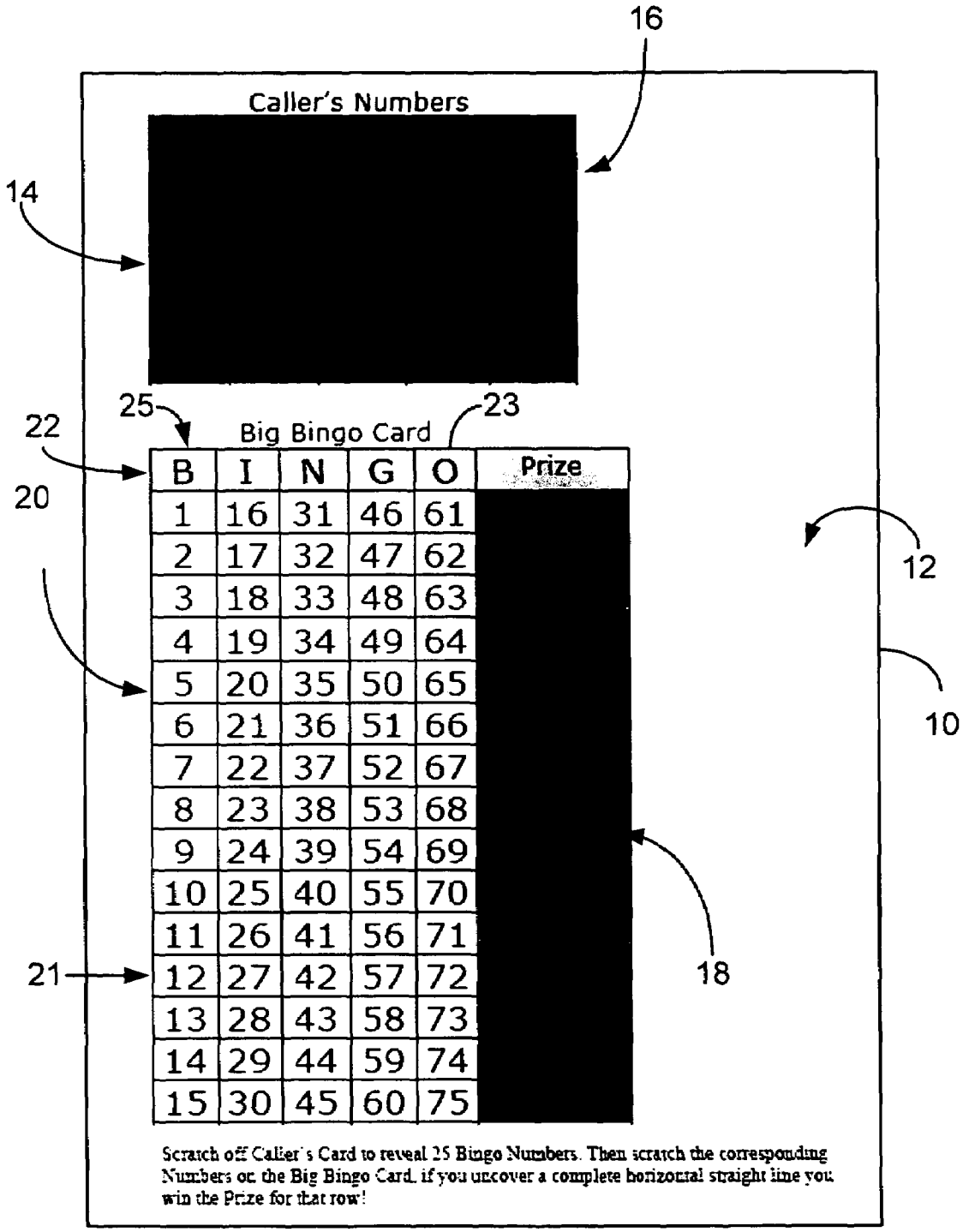
FIG. 1 is a schematic illustration of a bingo game card of the invention in which the scratch-off layer of the ticket has not yet been removed.
Figure 2:
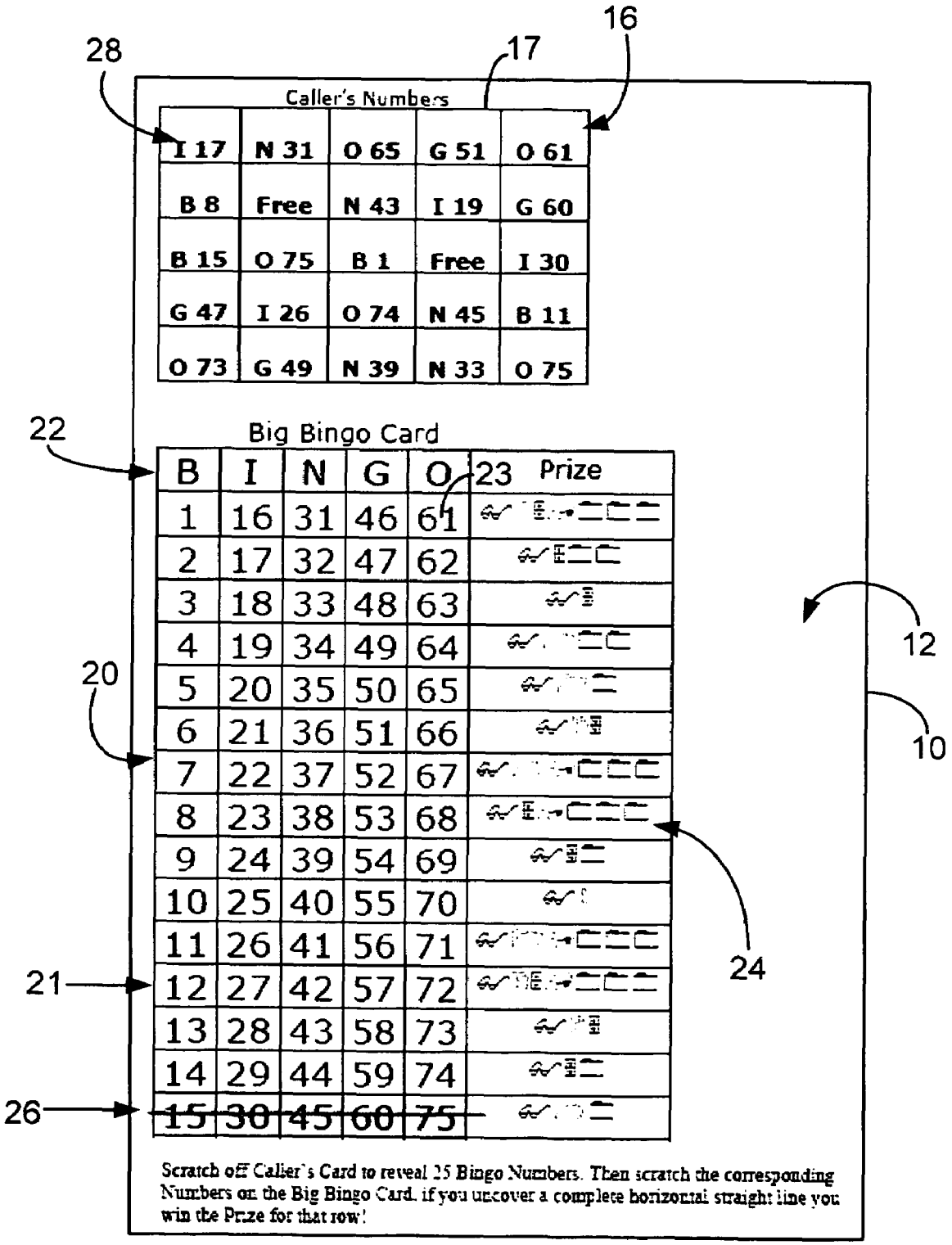
FIG. 2 is a schematic illustration of the ticket of FIG. 1 in which the scratch-off layer has been removed to reveal the second set of game indicia and prize indicators.

With reference now to the drawings, in which like numerals represent like elements throughout, FIG. 1 shows a bingo game card 10 of the invention in which the scratch-off layers, covering 14 over the second set 16 of game indicia and covering 18 over the set of prize indicators 24, of the card 10 has not yet been removed. FIG. 2 shows the coverings 14 and 18 removed. In this embodiment, the scratch-off lottery game card 10 with a substrate 12 and a first set of game indicia 20 of a first type on the substrate 12 and arranged in a grid 23 comprised of a plurality of rows of cells, such as row 21, and columns of cells, such as column 25. The grid 23 having at least one row 22 of cells having a indicia of a second type with a unique one of the indicia of a second type defining a particular column of the grid 23. The second set 16 of game indicia are shown here are contained within a grid 17. Each of the second set 16 of game indicia, such as caller number 28, is comprised of a grouping of one of the first type of game indicia and one of the second type of game indicia such that each of the second set of indicia defines a cell of the grid 23 of first set of game indicia. A set of prize indicators 24 on the substrate 12 adjacent the grid 23 of the first set 20 of game indicia thereby defining a row of the grid 23, e.g. row 21, wherein each of the prize indicators indicates a prize for a defined row wherein each cell of the defined row containing a game indicia of the first type. Here, the indicia of a first type are shown as numbers and the indicia of a second type are shown as letters, although, either can be reversed or other combinations of alphanumeric characters or symbols can be used to create the sets of game indicia.

There have been many different styles of bingo games that have been marketed as scratch-off tickets, but this new play style has applications that are far different to those of current bingo game incarnations. With this new play style all 75 bingo numbers are used on a single player's game card 10 or ticket. With each horizontal line across, e.g. line 21 there is a variable prize assigned to that line, which prize is covered with a scratch-off coating, e.g. covering 18, typically formed of a latex or a varnish type of coating, as known in the art.

The "caller's" numbers, here shown as the second set 16 of game indicia, of which there are generally 25 to 30 with current bingo games, are imaged indicia on the game card, typically done with a high speed ink jet imaging device, and are covered by a scratch-off coating or covering. With the inventive play mechanism of this invention there could be as many as 60 of these numbers used. When these numbers are uncovered by purchaser of the scratch card by removing the scratch off coating in known fashion, the numbers are then used to "mark" the Player's card. With this new play style "free" spaces may be added to the caller's card instead of the traditional player's card.

Additional bingo numbers can be added to the prize area of the card 10, e.g. prize indicators 24, to extend play and add excitement. If a complete horizontal line is uncovered on the card 10, for example line 26 in FIG. 2, the prize for that line is won. This allows for more wins on a single ticket than current bingo variations.

The play style of this new bingo game thus differs from the known games in that the purchaser is using a single player's card instead of at least four true bingo cards, referring here to the actual representative bingo game cards reproduced on the face of the game ticket or card, in which the numbers under each letter column, e.g., B1 to B15, I16 to I30, N31 to N45, G46 to G60 and O61 to O75, are usable in the game and where each horizontal line, e.g., B1, I16, N31, G46, O61, has a variable prize that is different, or which may be the same, as the next horizontal line.

This invention can be produced using any of the known marking systems in the lottery industry. Additional variations can be added to the illustrated play style patterns and play style to add interest to the game. For example, as "X", diamond, corner, square and number shapes or patterns may be played. Play variation can be added to the game to include diagonal and vertical lines winning via the same variable prize associated with each line or a prize legend.

As shown in the Figures, the invention therefore provides a method of making a scratch-off lottery game card 10 simulating the game of Bingo with the step of placing a first set 20 of game indicia of a first type on a substrate wherein the first set 20 of game indicia is arranged in a grid 23 comprised of a plurality of rows an columns of cells, placing at least one row 22 of cells of the grid 23 with an indicia of a second type wherein a unique one of the indicia of a second type defining a particular column 25 of the grid 23, placing a second set 16 of game indicia on the substrate 12, each of the second set 16 of game indicia comprised of a grouping of one of the first type of game indicia and one of the second type of game indicia such that each of the second set of indicia defines a potential indicia of a first type in a column of cells of the grid 23 of first set 20 of game indicia. Then the method includes the step of placing a set of prize indicators 24 on the substrate 12 adjacent the grid of the first set of game indicia thereby defining a row of the grid 23, e.g. row 21, wherein each of the prize indicators 24 indicates a prize for a defined row wherein each cell of the defined row contains a game indicia of the first type.

Although a preferred embodiment of the invention has been disclosed in the foregoing specification, it is understood by those skilled in the art that many modifications and other embodiments of the invention will come to mind to which the invention pertains, having the benefit of the teaching presented in the foregoing description and associated drawings. Moreover, although specific terms may be employed herein in a generic and descriptive sense only, it is not intended that they limit the described invention.

What is claimed is:

1. A scratch-off lottery game card, comprising:

a substrate;

a first set of game indicia of a first type on the substrate and arranged in a grid comprised of a plurality of rows of cells, each cell having a unique one of the first type of game indicia therein, the grid having at least one row of cells having indicia of a second type with a unique one of the indicia of a second type defining a particular column of the grid;

a second set of game indicia on the substrate located in an area separate from the first set of game indicia, each of the second set of game indicia comprised of a grouping of one of the first type of game indicia and one of the second type of game indicia such that each of the second set of game indicia defines a potential indicia of a first type in a column of cells of the grid of first set of game indicia;

the second set of game indicia being a subset of the total number of cell positions in the first set of game indicia such that every one of the second set of game indicia is present in the first set of game indicia; and a set of prize indicators on the substrate adjacent the grid of the first set of game indicia thereby defining a row of the grid, wherein each of the prize indicators indicates a prize for a defined row wherein each cell of the defined row containing a game indicia of the first type.

2. The scratch-off lottery game card of claim 1, wherein the second set of game indicia is in a grid.

3. The scratch-off lottery game card of claim 1, further comprising a removable coating over the second set of game indicia and the set of prize indicators.

4. The scratch-off lottery game card of claim 1, wherein the game indicia of a first type are numbers.

5. The scratch-off lottery game card of claim 1, wherein the game indicia of a second type are letters.

6. The scratch-off lottery game card of claim 1, wherein each of the set of prize indicators are horizontally adjacent to their respective defined row of the grid of the first set of game indicia.

7. A method of making a scratch-off lottery game card simulating the game of Bingo, comprising the steps of:

printing a first set of game indicia of a first type on a substrate wherein the first set of game indicia is arranged in a grid comprised of a plurality of rows of cells and columns of cells, each cell having a unique one of the first type of game indicia therein;

printing at least one row of cells of the grid with an indicia of a second type wherein a unique one of the indicia of a second type defining a particular column of the grid;

printing a second set of game indicia on the substrate located in an area separate from the first set of game indicia, each of the second set of game indicia comprised of a grouping of one of the first type of game indicia and one of the second type of game indicia such that each of the second set of indicia defines a a cell of the grid of first set of game indicia;

the second set of game indicia being a subset of the total number of cell positions in the first set of game indicia such that every one of the second set of game indicia is present in the first set of game indicia; and printing a set of prize indicators on the substrate adjacent the grid of the first set of game indicia thereby defining a row of the grid, wherein each of the prize indicators indicates a prize for a defined row wherein each cell of the defined row containing a game indicia of the first type.

8. The method of claim 7, wherein the step of printing the second set of game indicia is printing the second set of game indicia in a grid.

9. The method of claim 7, further comprising the step of placing a removable covering over the second set of game indicia and the set of prize indicators.

10. The method of claim 7, wherein the game indicia of a first type are numbers, and the step of printing the first set of game indicia is printing a set of numbers.

11. The method of claim 7, wherein the game indicia of a second type are letters, and the steps of printing the printing at least one row of cells of the grid with an indicia of a second type is printing letters.

12. The method of claim 7, wherein the step of printing the set of prize indicators is printing the each of the set of prize indicators horizontally adjacent to their respective defined row of the grid of the first set of game indicia.

13. A scratch-off lottery game card simulating the game of Bingo, comprising:

a substrate;

a single player's card section provided on the substrate in the form of a grid having a plurality of cells arranged in rows and columns, with each column identified by a unique letter and each cell containing a unique number;

a caller's card section provided on the substrate located in an area separate from the single player's card section, the caller's card section having game indicia identifying cells in the player's card section, and wherein all of the cells identified in the caller's card section are present in the single player's card section;

a plurality of prize indicators on the substrate adjacent to a plurality of different winning configurations of cells in the player's card section, wherein each of the prize indicators indicates a prize for a defined configuration of cells in the player's card matched by cell positions identified in the caller's card section; and a removable scratch-off coating applied over at least a portion of the player's card and the caller's card section.

14. The scratch-off lottery game card of claim 13, wherein the columns of cell positions in the player's card are identified by the letters B-l-N-G-O, and the cells under the B column contain numbers 1 through 15, the cells under the I column contain numbers 16 through 30, the cells under the N column contain numbers 31 through 45, the cells under the G column contain numbers 46 to 60, and the cells under the O column contain numbers 61 through 75.

15. The scratch-off lottery game card of claim 14, wherein the caller's card section identifies 25 different cell positions in the player's card.

16. The scratch-off lottery game card of claim 15, wherein at least one of the cell positions in the caller's card section is designated as a "free" cell.

17. The scratch-off lottery game card of claim 13, wherein a player wins the prize award indicated for each matched row in the player's card such that multiple prize awards are possible with the single player's card.

18. The scratch-off lottery game card of claim 13, wherein the plurality of prize indicators are adjacent to different rows of cells on the player's card, such that a horizontal row having matched by the cells in the caller's card section wins the prize associated with the respected prize indicator adjacent to the matched row.

19. The scratch-off lottery game card of claim 18, wherein a prize indicator is adjacent to every row of cells on the player's card.

* * * * *